United States Patent [19]

Moller et al.

[11] Patent Number: 4,560,348

[45] Date of Patent: Dec. 24, 1985

[54] GAS NOZZLE FOR A HEAT TREATING FURNACE

[75] Inventors: Craig A. Moller, Loves Park; Eric H. Wolter, Cherry Valley, both of Ill.

[73] Assignee: Abar Ipsen Industries, Feasterville, Pa.

[21] Appl. No.: 613,275

[22] Filed: May 24, 1984

[51] Int. Cl.[4] ..... F27D 15/02; F26B 21/12; B05B 1/00

[52] U.S. Cl. ..... 432/77; 34/241; 239/600; 239/602; 432/205

[58] Field of Search ..... 432/77, 205; 138/97, 138/118; 239/600, 602; 34/241

[56] References Cited

U.S. PATENT DOCUMENTS

| | | | |
|---|---|---|---|
| 1,770,548 | 7/1930 | Oven | 138/118 |
| 2,998,198 | 8/1961 | Young | 239/602 |
| 4,206,786 | 6/1980 | Wetmore | 138/99 |
| 4,395,832 | 8/1983 | Jones et al. | 34/233 |

*Primary Examiner*—John J. Camby

*Attorney, Agent, or Firm*—Leydig, Voit & Mayer

[57] ABSTRACT

A nozzle for delivering cooling gas into the work chamber of a heat treating furnace. The nozzle is formed by a resiliently yieldable metal tube having an overlapping seam and adapted to be contracted radially for insertion through a hole in the wall of the work chamber. After being inserted through the hole, the tube springs outwardly into frictional engagement with the edge of the hole to retain itself in place. Flares on the ends of the tube prevent the tube from shifting endwise relative to the chamber wall.

7 Claims, 4 Drawing Figures

GAS NOZZLE FOR A HEAT TREATING FURNACE

BACKGROUND OF THE INVENTION

This invention relates generally to a gas nozzle for a heat treating furnace and, more particularly, for a heat treating furnace of the type in which a walled enclosure is disposed within and is spaced inwardly from an outer shell and defines a heating chamber for workpieces. After the workpieces have been heated, a cooling gas in the space between the outer shell and the internal enclosure is circulated through the work chamber, the gas flowing into the chamber through a large number of nozzles which extend through the walls of the enclosure.

A heat treating furnace of this general type is disclosed in Jones et al U.S. Pat. No. 4,395,832. In that furnace, each of the nozzles is externally threaded and is removably secured to the wall of the internal enclosure by a pair of lock nuts.

SUMMARY OF THE INVENTION

The general aim of the present invention is to provide a new and improved self-retaining gas nozzle for a heat treating furnace, the nozzle being particularly characterized by its simplicity of construction and by the ease with which it may be installed in the furnace.

A more detailed object of the invention is to achieve the foregoing by providing a unique nozzle in the form of a resiliently yieldable metal tube which may be contracted radially for insertion through a hole in the wall and, after being so inserted, automatically springs outwardly into frictional engagement with the edge of the hole to retain itself in place.

The invention also resides in the formation of outwardly extending flares on the ends of the nozzle to direct the flow of gas into the nozzle and to restrict endwise shifting of the nozzle in the hole.

These and other objects and advantages of the invention will become more apparent from the following detailed description when taken in conjunction with the accompanying drawings.

DETAILED DESCRIPTION OF THE PREFERRED EMBODIMENT

Figure 1:
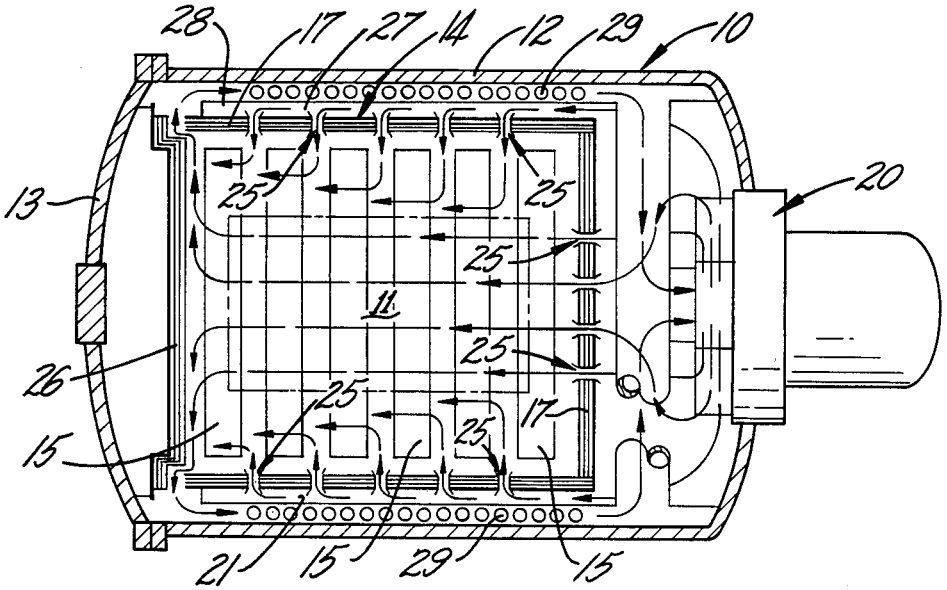
FIG. 1 is a schematic cross-sectional view taken longitudinally through a typical heat treating furnace equipped with new and improved gas nozzles incorporating the unique features of the present invention.

For purposes of illustration, the invention is shown in the drawings in conjunction with a vacuum furnace 10 for heat treating workpieces (not shown) in a chamber 11. In general, the furnace comprises an outer shell 12 formed with a circular cross-section and closed at one end by a releasable door 13. The heating chamber 11 is defined within a walled enclosure 14 disposed inside of the shell and spaced inwardly from the walls thereof.

Several electric resistance heating elements 15 are located within the internal enclosure 14.

Figure 2:
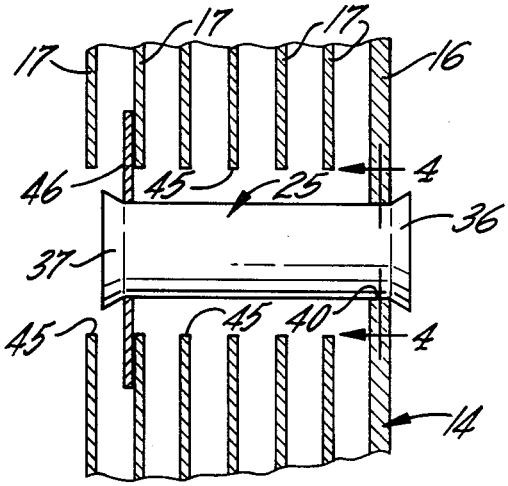
FIG. 2 is an enlarged cross-sectional view showing one of the nozzles mounted in the wall of the internal enclosure.

Herein, each wall of the internal enclosure 14 is defined by an outer plate 16 (FIG. 2) and by a pack of six shields 17 spaced from one another and located on the inner side of the plate. The shields are made of high temperature metal such as molybdenum and serve to insulate the chamber 11 from the shell 12 and to reflect radiation from the heating elements 15 back into the chamber. Reference may be made to Bornor U.S. Pat. No. 3,456,935 for a more detailed disclosure of a furnace internal having shielding packs.

After the workpieces have been heated, a motor-driven blower 20 at one end of the shell 12 circulates an inert cooling gas such as argon or nitrogen through the chamber 11 in order to quench the workpieces. As shown schematically in FIG. 1, the gas is directed into the space 21 between the shell 12 and the enclosure 14 and flows into the chamber through tubular nozzles 25 located in the wall of the enclosure 14. The gas discharged out of the chamber 11 flows past a shielding pack 26 on the door 13 and returns to the blower 20 via a plenum 27 defined between the shell 12 and a jacket 28 which encircles the enclosure 14. Banks of cooling coils 29 are located in the plenum and chill the gas during its return flow.

In order to introduce the cooling gas into the chamber 11 at several locations, the furnace 10 is equipped with a large number of nozzles 25 which are located at spaced locations around the chamber, the present furnace including over one hundred nozzles. In accordance with the present invention, each of the nozzles 25 is of relatively simple spring metal construction which enables the nozzle to be quickly and easily installed and retained in the wall of the internal enclosure 14.

Figure 3:
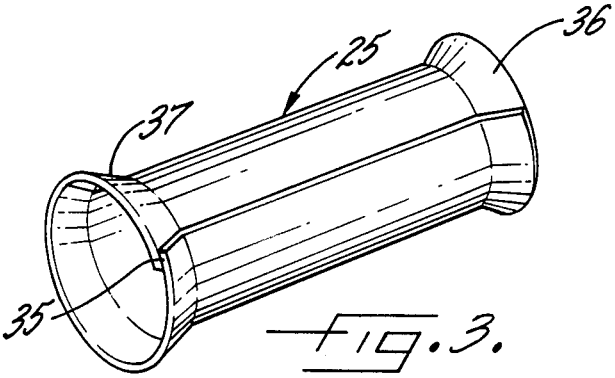
FIG. 3 is a perspective view of the nozzle shown in FIG. 2.

More specifically, each nozzle 25 is formed from an initially flat sheet of resiliently yieldable and temperature-resistant metal such as molybdenum. The initially flat sheet is rolled into a tube of circular cross-section by a coiling operation and is coiled such that its opposite edge portions overlap one another so as to form an overlapping seam 35 (FIG. 3) extending longitudinally of the tube. For a purpose to be explained subsequently, the outer and inner ends of the tube are flared outwardly as indicated at 36 and 37, respectively, after completion of the coiling operation. The junction between each flare and the cylindrical body of the tube is gradually radiused.

Figure 4:
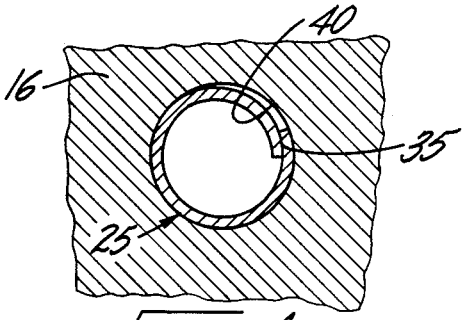
FIG. 4 is a cross-sectional view taken substantially along the line 4—4 of FIG. 3.

When the resiliently yieldable metal of the tube 25 is in a relaxed state, the outer diameter of the cylindrical body of the tube is somewhat larger than the diameter of a circular hole 40 (FIGS. 3 and 4) formed through the outer plate 16 of the enclosure 14. The overlapping edge portions of the seam 35 of the tube are not secured together but instead are free to move circumferentially relative to one another. Thus, by squeezing the tube with a tool (not shown), the tube may be contracted radially to reduce the outer diameter of the cylindrical body and the flare 36 to a dimension less than the diameter of the hole 40. After the tube has been so contracted, its outer end portion is inserted through the hole 40 from the inner side of the plate 16. When the radial squeezing force is removed from the tube, it tends to spring outwardly to its original diameter and, as a result, expands into frictional engagement with the edge of the hole 40. By virtue of such frictional engagement, the tube is held securely in the hole.

After the tube 25 has been installed in the hole 40 in the plate 16, the five outermost shields 17 are attached to the plate, the shields being formed with oversized holes 45 (FIG. 3) to accommodate the tube. Thereafter, the inner end portion of the tube is contracted radially to enable a retaining washer 46 to be telescoped over the flare 37 and located on the tube at a position disposed outwardly of the flare and inwardly of the fifth shield 17. The sixth or innermost shield 17 then is attached to complete the installation.

The washer 46 is captivated on the nozzle 25 by the outwardly extending flare 37 and engages the inner face of the fifth shield 17 to prevent outward shifting of the nozzle. Similarly, the flare 36 engages the outer side of the plate 16 to prevent inward shifting of the nozzle. In addition, the flare 36 improves the efficiency of the nozzle by funneling gas from the space 21 into the nozzle and reducing the tubulence otherwise resulting from a sharp-edged tube.

From the foregoing, it will be apparent that the present invention brings to the art a new and improved self-retaining nozzle 25 which may be quickly and easily installed from inside the furnace 10. The nozzle requires no threads, nuts, pins, wires or other retaining elements except for the washer 46. Even the washer may be eliminated by reducing the diameter of the hole in the innermost shield 17, by installing the shields prior to installing the nozzle, and by inserting the nozzle through the shields.

We claim:

1. A heat treating furnace comprising a shell, wall means disposed within said shell and defining a heating chamber inside of said shell, means for heating workpieces in said chamber, there being a space between said shell and said wall means, holes extending through said wall means, nozzles disposed in said holes and establishing communication between said space and said chamber, and means for causing gas to flow from said space and into said chamber through said nozzles, said furnace being characterized in that each of said nozzles comprises a sheet of resiliently yieldable metal rolled into a tube with one end portion of the sheet overlapping the opposite end portion of the sheet to form an overlapping seam extending longitudinally of the tube, the relaxed outer diameter of said tube being greater than the diameter of the hole for receiving said tube, the overlapping end portions of said seam being free to move circumferentially of one another whereby said tube may be contracted radially and inserted into said hole, the resiliency of said metal thereafter causing the tube to expand outwardly into frictional engagement with the edge of said hole to retain said tube in said hole.

2. A heat treating furnace as defined in claim 1 in which an outwardly extending flare is formed around the inlet end of each tube to funnel the flow of gas into the tube, said flare being engageable with the outer side of said wall means to restrict inward shifting of said tube.

3. A heat treating furnace as defined in claim 2 in which an outwardly extending flare also is formed around the discharge end of each tube.

4. A heat treating furnace as defined in claim 3 further including a washer telescoped over the discharge end of each tube, said washer being located outwardly of the flare on the discharge end of said tube and being engageable with said wall means to restrict outward shifting of said tube.

5. A gas nozzle for a heat treating furnace and comprising a single sheet of resiliently yieldable metal rolled into a tube with opposite end portions of the sheet overlapping one another to form an overlapping seam extending longitudinally of the tube, the overlapping end portions of said seam being free to move circumferentially of one another whereby the tube may be contracted inwardly by a radial squeezing force applied to the tube and, upon removal of the force, will expand outwardly by virtue of the resiliency of said material, and an outwardly extending flare formed around one end portion of said tube.

6. A gas nozzle as defined in claim 5 in which said flare is formed around the inlet end portion of said tube to funnel gas into the tube.

7. A gas nozzle as defined in claim 6 further including an outwardly extending flare formed around the discharge end portion of said tube.

* * * * *